US008506732B2

(12) United States Patent
Warner

(10) Patent No.: US 8,506,732 B2
(45) Date of Patent: Aug. 13, 2013

(54) HEAT TREATMENT OF HELICAL SPRINGS OR SIMILARLY SHAPED ARTICLES BY ELECTRIC RESISTANCE HEATING

(75) Inventor: Jerry G. Warner, Jackson, WI (US)

(73) Assignee: Radyne Corporation, Milwaukee, WI (US)

( * ) Notice: Subject to any disclaimer, the term of this patent is extended or adjusted under 35 U.S.C. 154(b) by 381 days.

(21) Appl. No.: 12/849,299

(22) Filed: Aug. 3, 2010

(65) Prior Publication Data

US 2011/0031666 A1 Feb. 10, 2011

Related U.S. Application Data

(60) Provisional application No. 61/232,058, filed on Aug. 7, 2009.

(51) Int. Cl.
*C21D 9/62* (2006.01)

(52) U.S. Cl.
USPC ..... 148/576; 148/566; 148/580

(58) Field of Classification Search
USPC ..... 148/566–568, 574–576, 580
See application file for complete search history.

(56) References Cited

U.S. PATENT DOCUMENTS 2,261,878 A 11/1941 Hathaway
6,235,131 B1 5/2001 Keihle et al.

*Primary Examiner* — Steven Bos
*Assistant Examiner* — Brian Walck
(74) *Attorney, Agent, or Firm* — Philip O. Post

(57) ABSTRACT

Apparatus and method are provided for metallurgical heat treatment of coil springs, or similarly shaped workpieces and articles of manufacture, by electric resistance heating along the entire length of the workpiece so that the ends of the workpiece can be heat treated to the same degree and quality as the section of the workpiece between its two ends.

12 Claims, 6 Drawing Sheets

HEAT TREATMENT OF HELICAL SPRINGS OR SIMILARLY SHAPED ARTICLES BY ELECTRIC RESISTANCE HEATING

CROSS-REFERENCE TO RELATED APPLICATIONS

This application claims the benefit of U.S. Provisional Application No. 61/232,058 filed Aug. 7, 2009, which is hereby incorporated by reference in its entirety.

FIELD OF THE INVENTION

The present invention relates to heat treatment of helical springs, or similarly shaped articles of manufacture by resistance heating.

BACKGROUND OF THE INVENTION

One method of forming a helically-shaped (coil) spring is by winding a wire feedstock heated to annealing temperature. Subsequent to cooling of the formed coil spring, the spring can be heat-treated, for example, by reheating to a suitable tempering temperature.

One method of heating a coil spring by electric resistance heating is described in U.S. Pat. No. 6,235,131 B1. In the disclosed method, connectors (38, 40) are connected to a suitable source of electric current, and are located remote from the free ends of the coil spring so that the spring is hardened, or tempered, by electric resistance heating in the coiled section between the connectors to a greater degree than that at the free ends of the spring.

Another method of accomplishing the tempering by electric resistance heating is described in U.S. Pat. No. 2,261,878. In the disclosed method, one extended end region of a spring 116 is placed in contact with a fixed plate-type electrical contact (electrode) 121 while the spring is compressed by a moveable plate-type electrical contact (electrode) 120 at its opposing extended end region as illustrated in FIG. 1(*a*) herein. Both fixed and moveable contacts are connected to a suitable source of electric current to heat treat the entire spring. A disadvantage of this method is that a significant extended end region of the spring makes partial physical contact with either electrical contact, for example, spring end region 116(*a*) and contact 120, as shown in FIG. 1(*b*). This arrangement does not generally establish a uniform cross sectional current density in the extended end regions of the spring, which can result in inadequate tempering in the extended end regions of the spring.

It is one objective of the present invention to temper, or otherwise metallurgically heat treat, a helical spring, or a similar article of manufacture, along its entire length while maintaining a substantially uniform cross sectional current density along the entire length of the spring that includes the ends of the spring, or the similar article of manufacture.

SUMMARY OF THE INVENTION

In one aspect the present invention is apparatus for, and method of, heat treating the entire length of a helical spring, or a similar article of manufacture, by electric resistance heating so that the ends of the spring are heat treated to the same degree of uniformity as the section of the spring between its two ends.

In another aspect the present invention is a heat treatment apparatus for an elongated workpiece having opposing ends disposed at an angle to the axial length of the elongated workpiece. A pair of end insert contacts is provided. Each one of the contacts making up the pair of end insert contacts is formed from a solid electrically conductive material and has a notch. The end insert contacts are spaced apart from each other so that the opposing ends of the elongated workpiece can be at least partially inserted in the notches of the pair of end insert contacts. An electric power source for supplying current to the pair of end insert contacts is provided. Electrical conductors connect each one of the end insert contacts to the electric power source. An end clamp can be provided for at least one of the end insert contacts. The end clamp can apply a compression force against an exposed surface region of the end of the elongated workpiece that is inserted into the notch of the end insert contact to force the surface area of the inserted end of the workpiece against the interior surface area of the notch during the supply of current from the power source for heat treatment of the workpiece. A driver can be provided for moving at least one of the pair of end insert contacts along the axial length of a workpiece having its opposing ends inserted in the notches of the end insert contacts. The heat treatment apparatus can also have a complementary end insert contact for each one of the pair of end insert contacts. The complementary insert contact has a complementary notch so that when the complementary insert contact is positioned adjacent to an end insert contact the end of the workpiece inserted in the end insert contact is substantially enclosed by the combination of the notches in the end insert contact and the complementary end insert contact. A complementary end insert contact electrical conductor for connection of each one of the complementary end insert contacts to the electric power source is provided.

In another aspect the present invention is a method of heat treating an elongated workpiece having opposing ends disposed at an angle to the axial length of the workpiece. Each one of the opposing ends of the elongated workpiece is at least partially inserted in a notch in each one of the pair of end insert contacts. An electric potential is applied across the pair of end insert contacts by connecting the pair of end insert contacts to a power supply, which establishes a current flow through the elongated workpiece that resistance heat treats the workpiece while the end insert contacts are Joule heated to the heat treatment temperature of the opposing ends of the elongated workpiece.

In another aspect the present invention is an apparatus for, and method of, selectively heat treating a plurality of diverse elongated workpieces having opposing ends disposed at an angle to the axial length of each diverse elongated workpiece.

In another aspect the present invention is a coil spring metallurgically heat treated by electric resistance heating whereby the opposing ends of the coil spring are each at least partially disposed in a separate end insert contact, and an electrical current is supplied to the separate end insert contacts to resistance heat the separate end insert contacts and the coil spring to a heat treatment temperature.

The above and other aspects of the invention are further set forth in this specification and the appended claims.

BRIEF DESCRIPTION OF THE DRAWINGS

For the purpose of illustrating the invention, there is shown in the drawings a form which is presently preferred. It being understood, however, that this invention is not limited to the precise arrangements and instrumentalities shown.

FIG. 1(*b*) is a partial side view through line A-A in FIG. 1(*a*) of a coil spring end section and adjacent electrical contact of the apparatus shown in FIG. 1.

FIG. 6(*b*) is an elevational view of one example of a driver for moving an end insert contact along the axial length of a workpiece inserted in the end insert contact.

FIG. 7(*b*) and FIG. 7(*c*) are plan views of bottom and top mounting plates that are used in the apparatus shown in FIG. 7(*a*).

FIG. 9(*b*) is the elongated workpiece shown in FIG. 9(*a*) in an apparatus of the present invention where a compression force is applied to the ends of the workpiece during the resistance heat treatment process.

DETAILED DESCRIPTION OF THE INVENTION

While the present invention will be described in connection with a preferred embodiment, it will be understood that it is not intended to limit the invention to that embodiment. On the contrary, it is intended to cover all alternatives, modifications and equivalents as may be included within the scope of the invention.

Figure 1A:
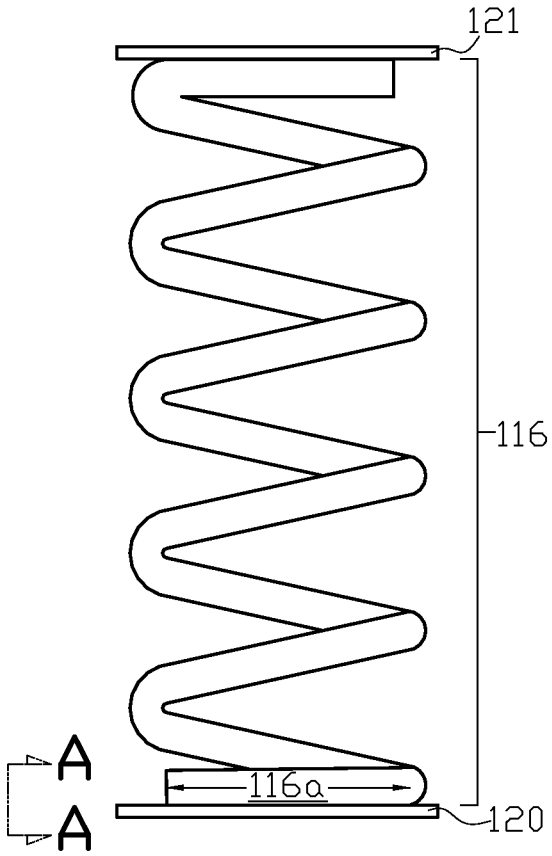
FIG. 1(*a*) is an elevational view of one example of a prior art apparatus for electric resistance heating of a coil spring.
Figure 1B:
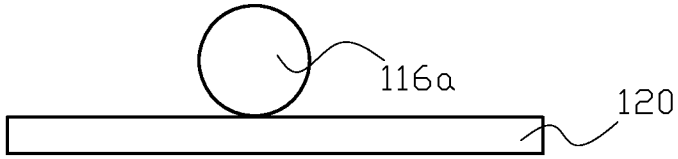
FIG. 1(b) PRIOR ART
Figure 2:
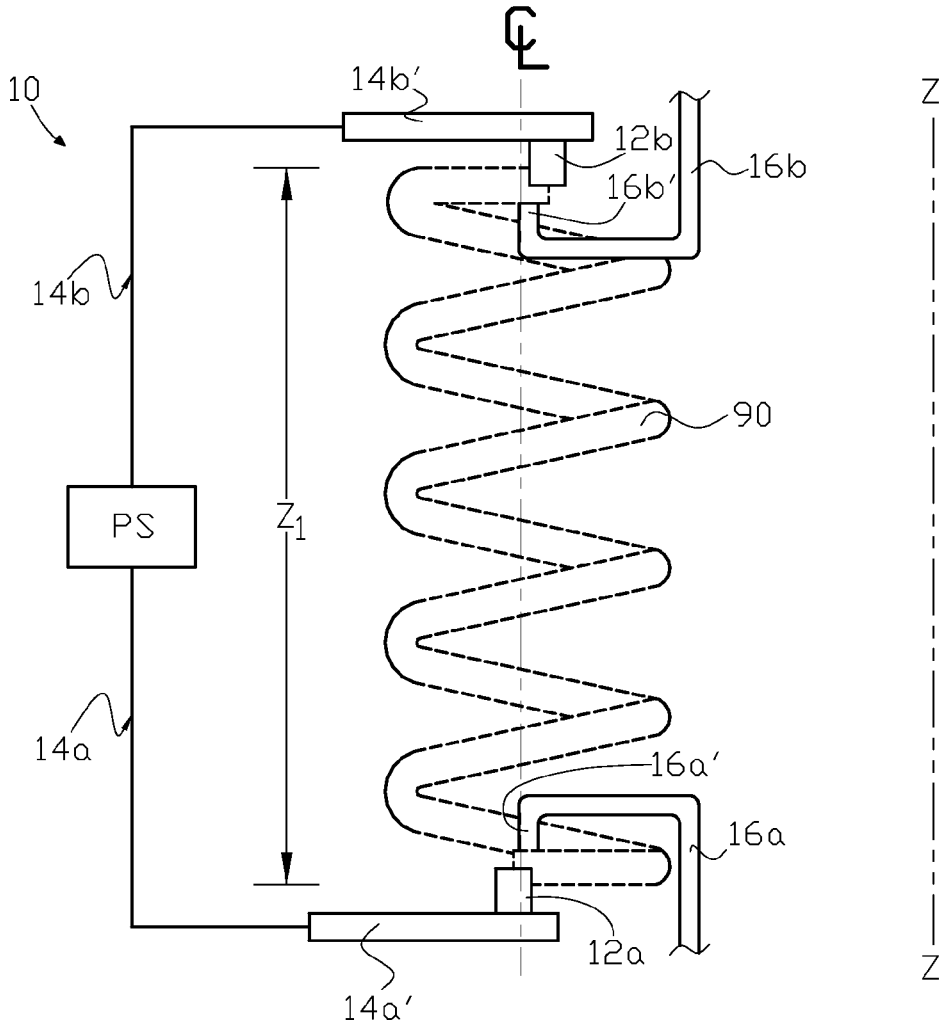
FIG. 2 is an elevational view of one example of an apparatus of the present invention for heat treatment of a workpiece.
Figure 3A:
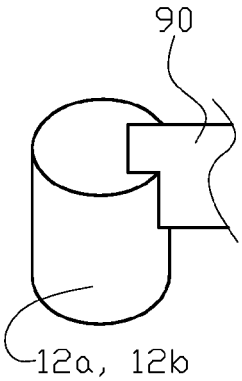
FIG. 3(*a*) through FIG. 3(*g*) are detail views of one example of a workpiece end insert contact utilized in the apparatus shown in FIG. 2, and FIG. 3(*h*) is a detail view of the interface surfaces between an end-of workpiece and a seating notch in an end insert contact utilized in the present invention.
Figure 3B:
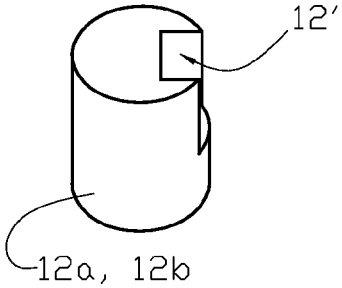
Figure 3C:
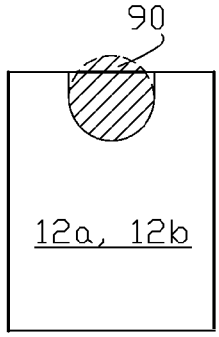
Figure 3D:
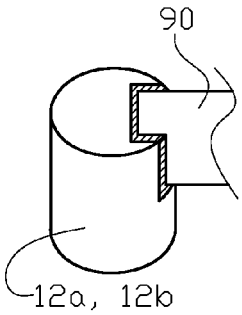
Figure 3E:
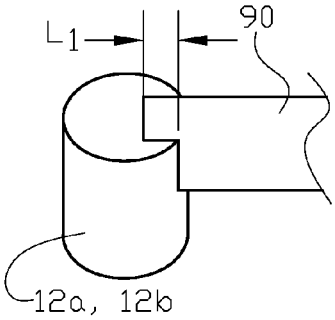
Figure 3F:
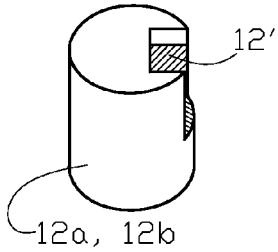
Figure 3G:
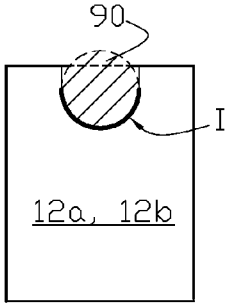
Figure 3H:
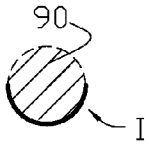

In one non-limiting example of the apparatus, and method, of the present invention, as illustrated in FIG. 2, apparatus 10 comprises end insert contacts 12*a* and 12*b* which are connected to a suitable power source (PS) via electrical conductors 14*a* and 14*b*, and interfacing electrical conductors 14*a*' and 14*b*' whereby an electric potential is applied across the end insert contacts and causes a heat treatment current flow through a workpiece positioned in the end insert contacts. Conductors 14*a*, 14*a*', 14*b* and 14*b*' represent one typical, but non-limiting method, or means, of supplying power from the power source to end insert contacts 12*a* and 12*b*, which may also be described as end-of-workpiece electrical contacts. For example conductors 14*a*' and 14*b*' may be in the form of electrical bus bars or conductive plates, and conductors 14*a* and 14*b* may be in the form of electrical cables.

Figure 8:
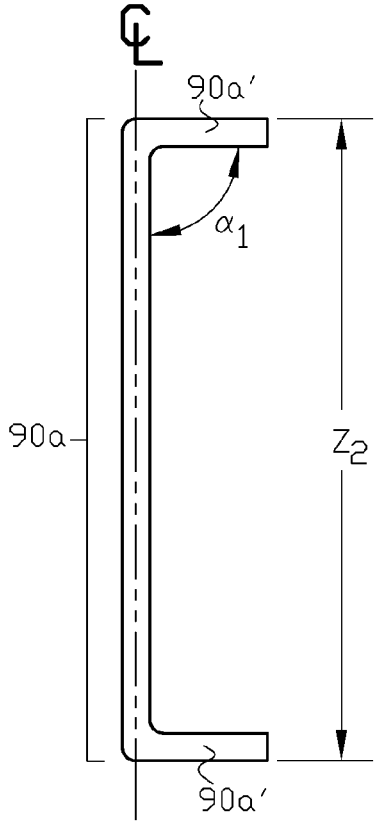
FIG. 8 is one example of an elongated workpiece similar to a coil spring that can be heat treated in some examples of the apparatus of the present invention.
Figure 9A:
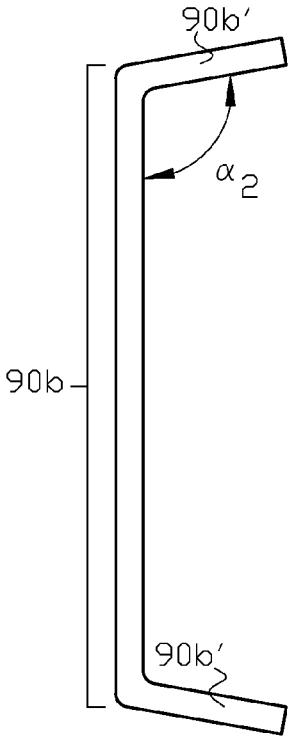
FIG. 9(*a*) is another example of an elongated workpiece similar to a coil spring that can be heat treated in some examples of the apparatus of the present invention.
Figure 9B:
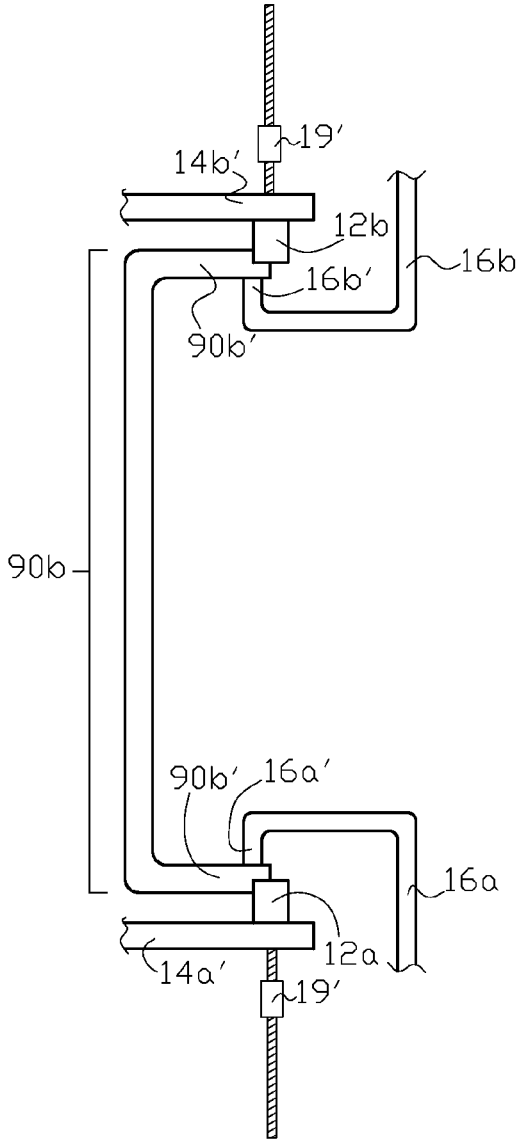

Workpiece 90 (shown in dashed lines FIG. 2) that is to be heat treated in apparatus 10 may be a helical (coil) spring or other article of manufacture formed from a longitudinally-oriented feedstock such as a length of wire or rectangular bar. A coil spring represents one type of such elongated workpieces that can be metallurgically heat treated with the apparatus and method of the present invention. While workpiece 90 is described as being generally circular in cross section, workpieces of other shapes, for example an elongated bar, or spring formed with a rectangular or square cross section, can be heat treated with the apparatus and method of the present invention. More generally, the elongated workpiece has opposing ends disposed at an angle to the axial length of the elongated workpiece. For example, as shown in FIG. 8, elongated workpiece 90*a* has an axial length of $Z_2$ with opposing ends 90*a*' disposed at an angle, $\alpha_1$, of approximately 90 degrees from the longitudinal axis of the workpiece. The elongated workpiece 90*b* in FIG. 9(*a*) has opposing ends 90*b*' disposed at an angle, $\alpha_2$, at an angle greater than 90 degrees from the longitudinal axis of the workpiece. Optionally when workpiece 90*b* is inserted in an apparatus of the present invention, its ends (and axial length) may be compressed by the end insert contacts 12*a* and 12*b*, as shown in FIG. 9(*b*) and as further described below.

In one non-limiting example of the invention, as shown in FIG. 3(*a*), FIG. 3(*b*) and FIG. 3(*c*), each end insert contact (12*a*, 12*b*) comprises a solid, cylindrically shaped electrical conductor with an end-of-workpiece seating notch 12' in which an end of the workpiece is seated during the resistance heat treatment process of the workpiece.

In a preferred embodiment of the invention, during the resistance heat treatment process of the workpiece, each end insert contact is resistance (Joule) heated to a temperature that is approximately the same as the resistance heat treatment temperature required at each end of the workpiece to ensure uniform heat treatment at the ends of the workpiece. Otherwise a significant temperature gradient can exist throughout an end insert contact during the resistance heat treatment process, for example from 100° F. to 1600° F., which would negatively affect uniform heat treatment of the ends of the workpiece. As a preferred minimum, an interface region (shown cross hatched in FIG. 3(*d*)) in the seating notch of an end insert contact that is adjacent to the end-of-workpiece inserted in the seating notch should be at a temperature that is approximately the same as the resistance heat treatment temperature required at each end of the workpiece. The term "resistance heat treatment temperature" is the temperature versus time profile of resistance heat treatment temperature that is required for heat treatment of a particular workpiece; the heat treatment temperature may be a constant temperature or varied over the heat treatment time period. Controlling the shape or form of the end insert contact relative to the shape or form of the particular end-of-workpiece will ensure the desired resistance heating of the end insert contact and sufficient heating of the end insert contact boundary region around an end-of-workpiece inserted in the seating notch. For example the cross sectional form of the end insert contact or the resistivity of the end insert contact can be selected based on the resistance heat treatment temperature required for a particular end-of-workpiece positioned in the end insert contact.

Preferably, but not by way of limitation, an end insert contact is formed from a high temperature resistant, electrically conductive material composition. One suitable but non-limiting choice for an end insert contact composition is HAYNES® 230® with a resistivity ranging from 125.0 microhm-cm at room temperature to 127.1 at 1,800° F.

When the workpiece has a circular end-of-workpiece cross section the notch is preferably semicircular with a radius approximately equal to the cross sectional radius of the end of the workpiece to be heat treated as shown in FIG. 3(*a*) through FIG. 3(*c*). In one preferred embodiment of the invention, the seating notch is shaped so that the interior surfaces of the notch make contact with at least 40 percent of the outer perimeter surface of the end-of-workpiece seated in the notch. For example, as shown in FIG. 3(*e*), the end of workpiece 90 is inserted for length $L_1$ into the seating notch, and the surface area of this inserted workpiece length interfacing (in contact) with the interior surface area of the seating notch (shown in cross hatch in FIG. 3(*f*) and by thick interface boundary curve "I" in FIG. 3(*g*) and FIG. 3(*h*)) is at least 40 percent of the outer perimeter surface area of workpiece length $L_1$ that is inserted in the seating notch.

Figure 10:
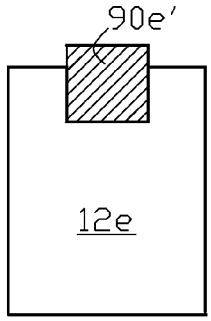
FIG. 10 is a cross sectional view of a workpiece having an end with a square cross section that is inserted into an end insert contact utilized in an apparatus of the present invention.

The shape of the end-of-workpiece seating notch in an end insert contact will change depending upon the shape of the end of a particular workpiece. For example, an apparatus of the present invention used to resistance heat treat a workpiece with a rectangularly-shaped cross sectional end 90*e*' will have a rectangularly-shaped seating notch for seating of the end of the workpiece in end insert contact 12*e* as shown, for example, in FIG. 10. That is, the interior of the seating notch in an end insert contact is selected to accommodate the configuration of the end of the particular workpiece being heat treated.

Referring to FIG. 2, clamps 16*a* and 16*b* represent one type of clamping device that can be optionally used to hold an end-of-workpiece in a seating notch during the resistance heat treatment process. Fingertips 16*a*' and 16*b*' of clamps 16*a* and 16*b*, respectively, can be applied with a compressive force against the surface of the ends of the workpiece opposite the end-of-workpiece surfaces seated in the notches to enhance physical contact between the interfacing end-of-workpiece and seating notch interior surfaces for an evenly distributed current density across this interface during the resistance heat treatment process. At least the fingertip of each clamp is formed from a high temperature resistant material composition, such as a ceramic composition, as shown, for example, in detail for alternative clamp 16*c* in FIG. 6(*a*) with ceramic fingertip 16*c*'.

Figure 6A:
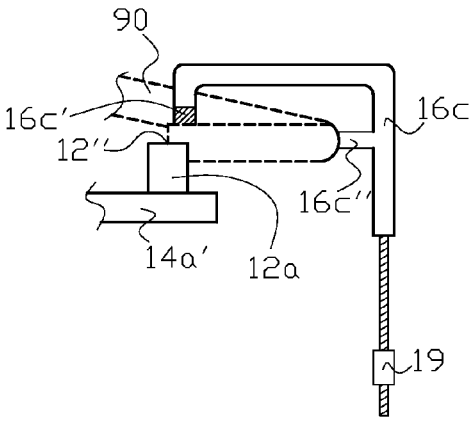
FIG. 6(*a*) is an elevational view of one example of an end-of-workpiece clamping device used in some examples of the invention to retain the end-of-workpiece in an end insert contact.
Figure 6B:
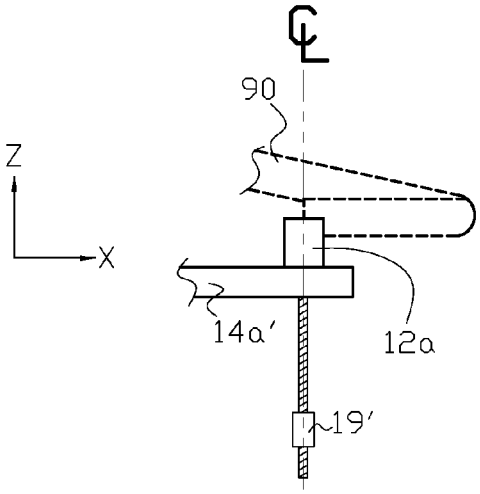

Preferably the moveable clamping mechanism is arranged to automatically clamp an end of the workpiece inserted in the seating notch of each end insert contact. For example as shown in FIG. 6(*a*) a linear driver 19, such as an electric or hydraulic cylinder or screw drive, can be used to lower or raise the clamp in the Z-direction, to or from its clamping position shown in FIG. 6(*a*). Optionally, in addition to, or as an alternative to, vertically oriented clamp fingertip 16*c*', horizontally oriented clamp fingertip 16*c*" may be provided as shown in FIG. 6(*a*) to apply a compression force to the extreme end-of-workpiece against the rear wall 12" in the seating notch.

Figure 4:
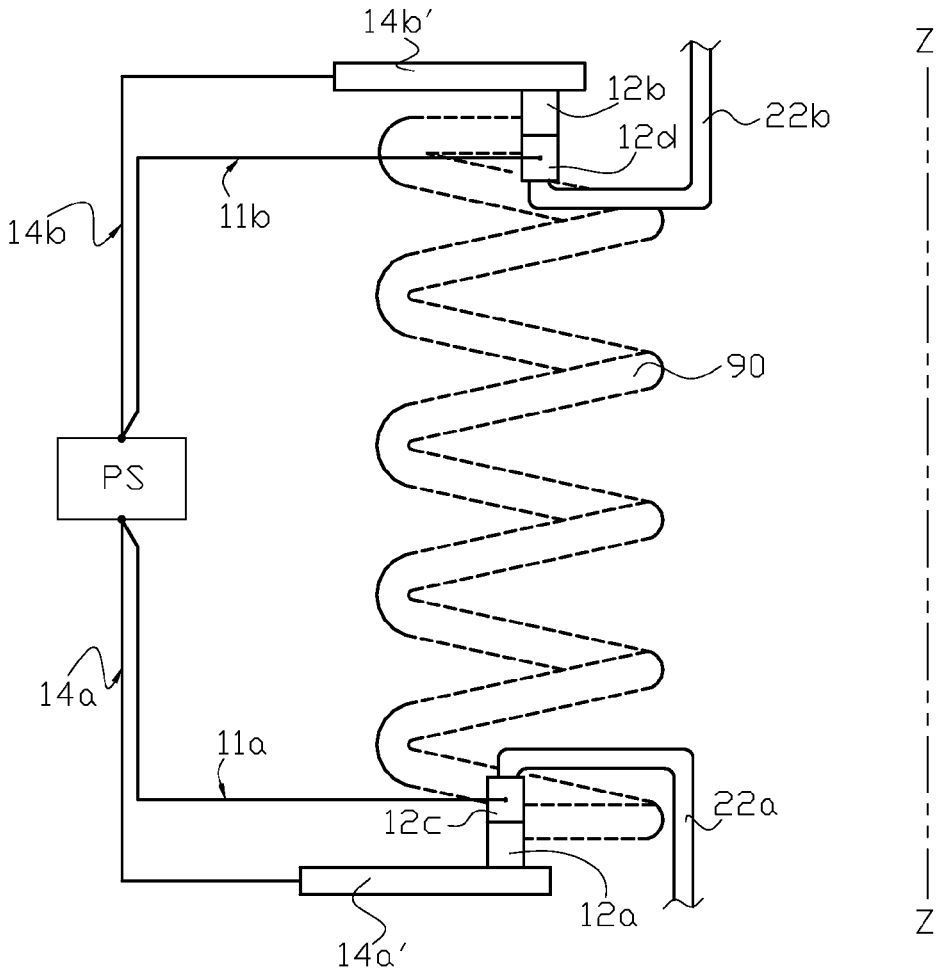
FIG. 4 is an elevational view of an example of another apparatus of the present invention for heat treatment of a workpiece.
Figure 5A:
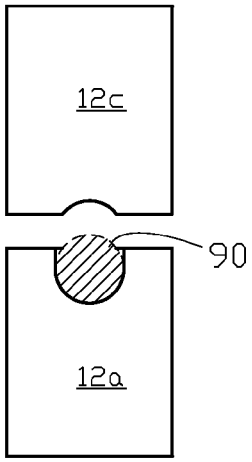
FIG. 5(*a*) and FIG. 5(*b*) are detail views of one example of the workpiece end contacts utilized in the apparatus shown in FIG. 4.
Figure 5B:
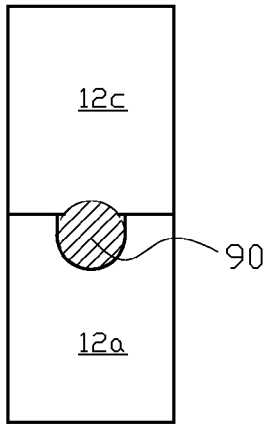

In another embodiment of the present invention complementary electrical contacts 12*c* and 12*d* can be provided as shown in FIG. 4. In this alternative arrangement, in addition to the electric current supplied to end insert contacts 12*a* and 12*b* during the heat treatment process described in a previous embodiment of the invention, electric current can be supplied to complementary electrical contacts 12*c* and 12*d* via electrical conductors 11*a* and 11*b* from power source (PS) to ensure approximately 360 degrees of uniform current density around the perimeter of each end-of-workpiece located in an end insert contact. The notch, or cutout, in each complementary contact 12*c* or 12*d* can be configured to surround the outer perimeter surface area of length $L_1$ inserted in the seating notch of an end insert contact as illustrated in FIG. 5(*a*) and FIG. 5(*b*) for end insert contact 12*a* and complementary electrical contact 12*c*. Complementary contact drive mechanisms 22*a* and 22*b* may be similar to a clamp drive mechanism as described above and are provided to move a complementary electrical contact away from an end insert contact as shown in FIG. 5(*a*) and to move the complementary electrical contact adjacent to an end insert contact as shown in FIG. 5(*b*) during the resistance heat treatment process.

Figure 7A:
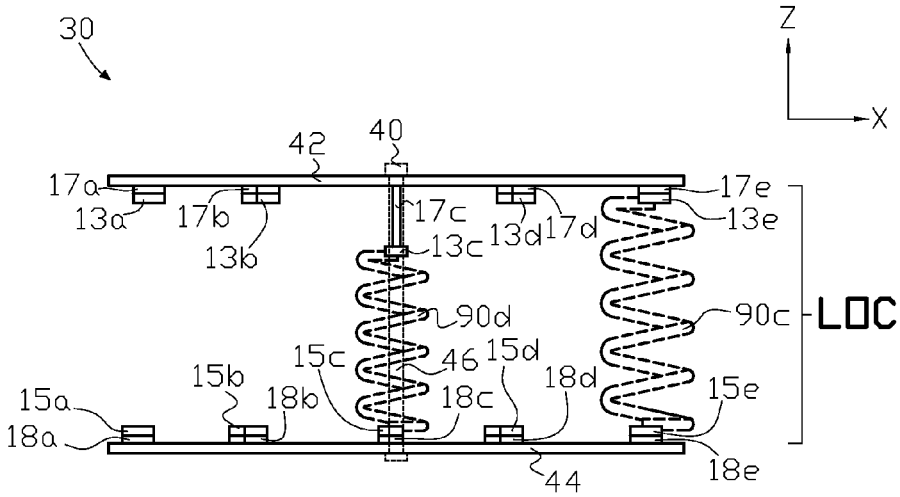
FIG. 7(*a*) is a cross sectional elevational view of one example of an apparatus of the present invention for resistance heat treatment of diverse workpieces.
Figure 7B:
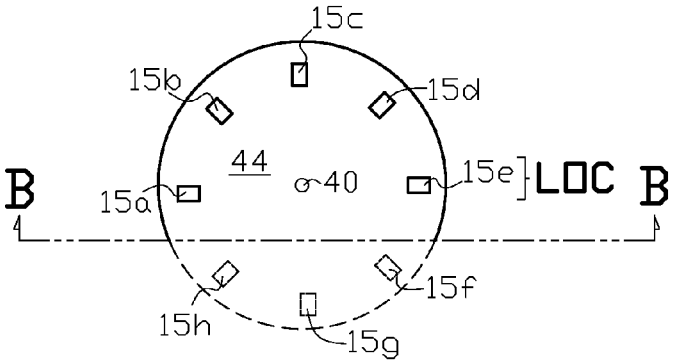
Figure 7C:
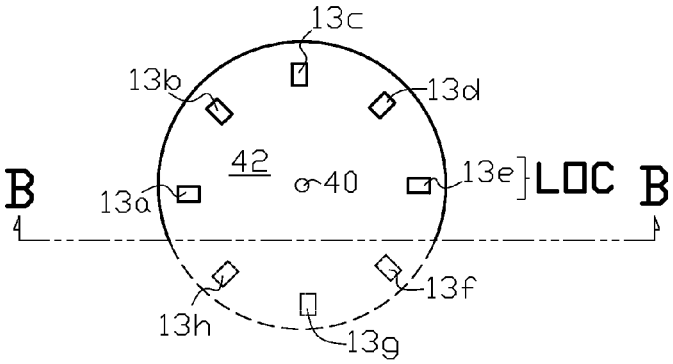

A plurality of alternative paired end insert contacts having different configurations can be provided in an apparatus of the present invention to accommodate resistance heat treatment of diverse workpieces according to the process of the present invention. The diversity of workpieces can include differences in axial length and/or end cross sections. FIG. 7(*a*) illustrates, in cross section, one example of an apparatus 30 of the present invention for selectively resistance heat treating of diverse workpieces. FIG. 7(*b*) and FIG. 7(*c*) illustrate bottom and top mounting plates 44 and 42 utilized in apparatus 30. Referring to FIG. 7(*b*) and FIG. 7(*c*), eight paired top and bottom end insert contacts, pairs 13*a*-15*a* through 13*h*-15*h*, provide eight heat treatment stations for the heating of diverse workpieces. The cross section of apparatus 30 in FIG. 7(*a*) is through line B-B in FIG. 7(*b*) and FIG. 7(*c*) so that top and bottom insert pairs 13*f*-15*f* through 13*h*-15*h* are not seen in FIG. 7(*a*). In this non-limiting example of the invention, electrical conductors 17*a* through 17*e* are connected to top end insert contacts 13*a* through 13*e*, respectively, and electrical conductors 18*a* through 18*e* are connected to bottom end insert contacts 15*a* through 15*e*. Each of the eight pairs of top and bottom insert contacts may have seating notches with different cross sectional shapes to accommodate eight diverse workpieces with different end cross sectional shapes. Two or more of the paired top and bottom insert contacts may be spaced apart at different distances to accommodate diverse workpieces having different axial lengths. For example as shown in FIG. 7(*a*), workpiece 90*d* positioned in end insert contacts 13*c* and 15*c* has a shorter axial length than workpiece 90*c* positioned in end insert contacts 13*e* and 15*e*. In the arrangement shown in FIG. 7(*a*) top electrical conductor 17*c* is laterally extended downwards to accommodate the shorter spaced apart distance between top and bottom end insert contacts 13*c* and 15*c*.

In this non-limiting example of the invention, top and bottom mounting plates 42 and 44 are spaced apart from each other and rotatable via driver 40 to form a rotating carousel apparatus. One location around the carousel (LOC) can be designated a workpiece load and unload station. While top and bottom end insert contact pair 13*e*-15*e* are presently in location (LOC) in the figures, rotational driver 40 can rotate the carousel apparatus to position the appropriate top and bottom end insert contact pair in location (LOC) to perform the resistance heat treatment process for a particular diverse workpiece. Electrical connecting means can be provided for connecting the top and bottom electrical conductors associated with the top and bottom end insert contact pair in location (LOC) to a suitable power source so that the heat treatment process can be performed. In some examples of the invention, interchangeable carousel apparatus 30 can be provided to accommodate resistance heat treatment of additional diverse workpieces, for example, with axial lengths and/or different end cross sections that can not be accommodated by the end insert contacts on a single carousel apparatus.

An automated robotic workpiece transfer apparatus may be provided to transfer a workpiece from a supply stock of workpieces to be heat treated in an apparatus of the present invention with the robotic workpiece transfer apparatus programmed to grasp the workpiece at appropriate locations and transfer the ends of the workpiece automatically into the seating notches of the end insert contacts without human operator intervention. Further in some examples of the invention, the end clamp mechanism and function may be incorporated into the robotic workpiece transfer apparatus so that the robotic workpiece transfer apparatus holds the ends of the workpiece in the seating notches of the end insert contacts during the heat treatment process.

In some examples of the invention if the workpiece requires quench treatment, an apparatus of the present invention may also comprise quench features. For example after completion of workpiece heating, an automated robotic workpiece transfer apparatus can transfer the workpiece to a quench station where the heat treated workpiece is either sprayed with a quenchant or dipped in a quench bath. Alternatively, one or both end insert contacts of the apparatus may be arranged to move after completion of workpiece heat treatment to cause the workpiece to initiate a gravity free fall directly to a quench station or quench bath, or indirectly, for example, via a transfer chute or conveyor. Alternatively the workpiece may be quench treated while still being held in place by the end insert contacts after completion of heat treatment by positioning quench supply apparatus (for example, one or more complete or partial quench rings) around the workpiece.

A direct current (DC) power source (PS) is preferred to eliminate current skin effect through the length of the workpiece although an alternating current (AC) power source may be appropriate for a particular workpiece configuration.

In all examples of the invention, an opposing pair of end insert contacts may be spaced apart at a fixed distance (for example, distance $Z_1$ in FIG. 2 for contacts 12*a* and 12*b*) along the Z-axis, or one or both of the contacts may be moveable mounted in the Z-direction to accommodate different axial lengths of workpieces, or to apply a compressive or tensile force to the workpiece during the resistance heat treatment process. For example, as illustrated in FIG. 6(*b*) driver 19', such as an electric or hydraulic cylinder or screw drive, may be used to move end insert contact 12*a* in the Z-direction to compress or tension workpiece 90 while it is being resistance heat treated. End insert contact 12*a* may move independently from associated conductor 14*a*', or the combination of contact 12*a* and conductor 14*a*' may move together. If insert contact 12*a* moves independently from conductor 14*a*' then a flexible electrical extension conductor can be provided between conductor 14*a*' and contact 12*a* to maintain an electrical path between conductor 14*a*' and contact 12*a* as contact 12*a* moves away from conductor 14*a'*.

Although the electrical contacts shown in the figures are vertically oriented to each other, the orientation may be in any other direction, such as but not limited to horizontal orientation, in other examples of the invention.

If the workpiece is a hollow workpiece an apparatus of the present invention may also include provisions for supply of a cooling medium through the hollow interior of the workpiece while the workpiece is mounted in the end insert contacts.

The present invention may be embodied in other specific forms without departing from the essential attributes thereof and, accordingly, reference should be made to the appended claims, rather than to the foregoing specification, as indicating the scope of the invention. The above examples of the invention have been provided merely for the purpose of explanation, and are in no way to be construed as limiting of the present invention. While the invention has been described with reference to various embodiments and examples, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification, may effect numerous modifications thereto, and changes may be made without departing from the scope of the invention in its aspects.

The invention claimed is:

1. A method of heat treating an elongated workpiece having opposing ends disposed at an angle to the axial length of the elongated workpiece, the method comprising the steps of:

inserting each one of the opposing ends of the elongated workpiece at least partially in a seating notch in one of a pair of end insert contacts; and applying an electric potential across the pair of end insert contacts to establish an electric current flow through the pair of end insert contacts and the elongated workpiece to resistance heat the elongated workpiece to one or more heat treatment temperatures over a heat treatment time period while the pair of end insert contacts are resistance heated to approximately one or more heat treatment temperatures for each one of the opposing ends of the elongated workpiece at least partially inserted in the seating notch of each one of the pair of end insert contacts.

2. The method of claim 1 wherein the step of inserting each one of the opposing ends of the elongated workpiece at least partially in the seating notch in one of the pair of end insert contacts further comprises interfacing the interior surface area of the seating notch in each one of the pair of end insert contacts and the surface area of each one of the opposing ends of the elongated workpiece at least partially inserted in each one of the pair of end insert contacts with the interior surface area of the seating notch being at least 40 percent of the surface area of the one of the opposing ends of the elongated workpiece at least partially inserted in the seating notch.

3. The method of claim 1 further comprising the step of applying a compression force to an exposed surface area of at least one of the opposing ends of the elongated workpiece at least partially inserted in the seating notch of at least one of the end insert contacts to force the surface area of the at least one of the opposing ends of the elongated workpiece at least partially inserted into the seating notch against the interior surface area of the seating notch during the electric current flow.

4. The method of claim 1 further comprising the step of moving at least one of the pair of end insert contacts along the axial length of the elongated workpiece to apply a compression or tension force to the elongated workpiece during the supply of the electric current flow subsequent to the step of inserting each one of the opposing ends of the elongated workpiece at least partially in the seating notch of each one of the pair of end insert contacts.

5. The method of claim 1 further comprising the steps of:

positioning one of a pair of complementary end insert contacts adjacent to each one of the pair of end insert contacts to substantially enclose the opposing ends of the elongated workpiece at least partially inserted in the seating notch in each one of the pair of end insert contacts; and applying the electric potential across the pair of complementary end insert contacts to establish a complementary electric current flow through the pair of complementary end insert contacts and the elongated workpiece in combination with the electric current flow through the pair of end insert contacts and the elongated workpiece.

6. A method of heat treating an elongated workpiece having opposing ends disposed at an angle to the axial length of the elongated workpiece, the method comprising the steps of:

inserting each one of the opposing ends of the elongated workpiece at least partially in a seating notch in one of a pair of end insert contacts;

applying an electric potential across the pair of end insert contacts to establish an electric current flow through the pair of end insert contacts and the elongated workpiece to resistance heat the elongated workpiece to one or more heat treatment temperatures over a heat treatment time period while the pair of end insert contacts are resistance heated to approximately one or more heat treatment temperatures for each one of the opposing ends of the elongated workpiece at least partially inserted in the seating notch of each one of the pair of end insert contacts; and applying a compression force to an exposed surface area of at least one of the opposing ends of the elongated workpiece at least partially inserted in the seating notch of at least one of the end insert contacts to force the surface area of the at least one of the opposing ends of the elongated workpiece at least partially inserted into the seating notch against the interior surface area of the seating notch during the electric current flow.

7. A method of heat treating an elongated workpiece having opposing ends disposed at an angle to the axial length of the elongated workpiece, the method comprising the steps of:

inserting each one of the opposing ends of the elongated workpiece at least partially in a seating notch in one of a pair of end insert contacts;

positioning one of a pair of complementary end insert contacts adjacent to each one of the pair of end insert contacts to substantially enclose the opposing ends of the elongated workpiece at least partially inserted in the seating notch in each one of the pair of end insert contacts;

applying an electric potential across the pair of end insert contacts to establish an electric current flow through the pair of end insert contacts and the elongated workpiece to resistance heat the elongated workpiece to one or more heat treatment temperatures over a heat treatment time period while the pair of end insert contacts are resistance heated to approximately one or more heat treatment temperatures for each one of the opposing ends of the elongated workpiece at least partially inserted in the seating notch of each one of the pair of end insert contacts; and applying the electric potential across the pair of complementary end insert contacts to establish a complementary electric current flow through the pair of complementary end insert contacts and the elongated workpiece in combination with the electric current flow through the pair of end insert contacts and the elongated workpiece.

8. A method of heat treating a coil spring having opposing spring ends disposed at an angle to the axial length of the coil spring, the method comprising the steps of:

inserting each one of the opposing spring ends at least partially in a seating notch in one of a pair of end insert contacts; and applying an electric potential across the pair of end insert contacts to establish an electric current flow through the pair of end insert contacts and the coil spring to resistance heat the coil spring to one or more heat treatment temperatures over a heat treatment time period while the pair of end insert contacts are resistance heated to approximately one or more heat treatment temperatures for each one of the opposing spring ends at least partially inserted in the seating notch of each one of the pair of end insert contacts.

9. The method of claim 8 wherein the step of inserting each one of the opposing spring ends at least partially in the seating notch in one of the pair of end insert contacts further comprises interfacing the interior surface area of the seating notch in each one of the pair of end insert contacts and the surface area of each one of the opposing spring ends at least partially inserted in each one of the pair of end insert contacts with the interior surface area of the seating notch being at least 40 percent of the surface area of the opposing spring end at least partially inserted in the seating notch.

10. The method of claim 8 further comprising the step of applying a compression force to an exposed surface area of at least one of the opposing spring ends at least partially inserted in the seating notch of at least one of the pair of end insert contacts to force the surface area of the at least one of the opposing spring ends at least partially inserted in the seating notch against the interior surface area of the seating notch during the electric current flow.

11. The method of claim 8 further comprising the step of moving at least one of the pair of end insert contacts along the axial length of the coil spring to apply a compression or tension force to the coil spring during the electric current flow.

12. The method of claim 8 further comprising the steps of:

positioning one of a pair of complementary end insert contacts adjacent to each one of the pair of end insert contacts to substantially enclose the opposing spring ends at least partially inserted in the seating notch in each one of the pair of end insert contacts; and applying the electric potential across the pair of complementary end insert contacts to establish a complementary electric current flow through the pair of complementary end insert contacts and the coil spring in combination with the electric current flow through the pair of end insert contacts and coil spring.

* * * * *